United States Patent [19]

Roth

[11] 4,452,368

[45] * Jun. 5, 1984

[54] LIGHTWEIGHT CONTAINER

[75] Inventor: Donald J. Roth, Westport, Conn.

[73] Assignee: The Continental Group, Inc., New York, N.Y.

[ * ] Notice: The portion of the term of this patent subsequent to Nov. 29, 2000 has been disclaimed.

[21] Appl. No.: 191,226

[22] Filed: Sep. 26, 1980

[51] Int. Cl.[3] ..... B65D 8/08; B65D 8/22

[52] U.S. Cl. ..... 220/67; 220/1 BC; 220/66; 220/70

[58] Field of Search ..... 92/347, 348, 249; 113/120 M, 120 H, 120 S, 120 P, 120 Z; 220/66, 67, 1 BC, 70, 5 A, DIG. 1

[56] References Cited

U.S. PATENT DOCUMENTS

| | | | |
|---|---|---|---|
| B 223,678 | 3/1976 | Nixon et al. | 220/70 X |
| D. 246,229 | 11/1977 | Saunders | 220/70 X |
| 1,788,261 | 1/1931 | Werder | 113/120 M |
| 2,107,232 | 2/1938 | Blakeway | 113/120 Z |
| 2,197,434 | 4/1940 | McManus et al. | 220/1 BC |
| 2,338,397 | 1/1944 | Beasley | 229/4.5 |
| 2,384,810 | 9/1945 | Calleson et al. | 220/1 BC |
| 3,084,826 | 4/1963 | Ericson | 220/309 |
| 3,385,470 | 5/1968 | Dorosz et al. | 220/67 |
| 3,760,751 | 9/1973 | Dunn et al. | 113/120 H |
| 4,006,838 | 2/1977 | Baumann et al. | 220/5 A X |
| 4,165,011 | 8/1979 | Holk, Jr. | 220/67 |
| 4,175,670 | 11/1979 | Reynolds et al. | 220/66 |
| 4,258,855 | 3/1981 | Gordon | 220/67 X |
| 4,313,545 | 2/1982 | Maeda | 220/74 X |

FOREIGN PATENT DOCUMENTS

| | | | |
|---|---|---|---|
| 2751039 | 5/1978 | Fed. Rep. of Germany | 220/77 |
| 598486 | 10/1959 | Italy | 220/66 |
| 729326 | 12/1966 | Italy | 220/5 A |
| 1452731 | 10/1976 | United Kingdom | 220/70 |

*Primary Examiner*—Allan N. Shoap

*Attorney, Agent, or Firm*—Charles E. Brown

[57] ABSTRACT

A novel pressure holding container formed of thin sheet metal of the order of between 10 and 4 mils wherein the container has a bottom portion and a top portion, the bottom portion having a body and an integral bottom, and in one embodiment having a necked-in upper end of the body which tightly fits into a lip portion of the lower end of the top portion and is adhesively bonded thereto and wherein the upper portion of the top portion has a toro-conical shape which under pressure wants to expand it into a spherical shape and thus through beam loading on the lip portion imposes compressive stresses thereon and holds in compression the adhesive which is interposed between the lip and the annulus of the necked-in portion of the body which is loaded in tension by the internal pressure in the container. In another embodiment of the invention, the body has no necking-in at its upper edge and is of uniform diameter from end to end and is tightly fitted into the lip of the upper portion and adhesively bonded thereto. The joint in each embodiment has thin lapped metal sections which deflect and transmit lateral loads imposed on the body and/or lip and thus attenuate the forces without imposing peeling forces on the adhesive. The conical sections are either stepped or smooth for different force loadings particularly in the application of different types of closures thereto.

15 Claims, 14 Drawing Figures

LIGHTWEIGHT CONTAINER

BACKGROUND OF THE INVENTION

Containers of the type under consideration are primarily made of aluminum and have a cylindrical body with an integral bottom. The top is usually closed by a generally flat end member of different alloy than the body which is usually H19-3004. The present commercial aluminum containers including ends weigh approximately 0.040–0.045 pounds each. The single service beverage cans of the 1960's was a three-piece steel body, steel bottom and an aluminum top. The most popular can of the 1970's was an all aluminum drawn and wall-ironed can with a double seamed top. The top was of a different alloy than the can body.

DESCRIPTION OF THE PROBLEM

Aluminum, because of its light weight and ductility and being able to be easily cast, is finding growing uses, most recently in the automotive industry. Material costs are rapidly escalating and the supply is dwindling. Various structures have been made to shape the bottom of the can to obtain more volume with less strength. Inverted or the champagne bottoms on the 1970 vintage cans have been used to hold the pressure, but this design is wasteful of the material in that a taller than necessary can must be provided necessitating additional material to obtain the desired volume. Furthermore, the flat top end requires the use of a strong alloy aluminum material having a magnesium content. The compositions of the body and that of the end of each can, being different, complicates recycling of the cans.

Steel cans on the other hand, because of the thickness of the metal used, require high tonnage presses and tools must be more frequently replaced. When thick metal is used, the costs and carrying weights becomes excessive. In order to obtain an easy opening feature, steel cans invariably use aluminum tops which complicates recycling. The aluminum and the steel must be separated which is a time consuming costly process. The attractiveness of steel for cans is in the lower cost of the metal and its greater availability.

SOLUTION OF THE PROBLEM

A primary object of the invention is to provide a pressure vessel design to create an optimum container.

The concave bottoms of the principal current designs 0.014 inches thick are replaced by a convex bottom about 0.008 inches thick which obtains increased volume with less aluminum.

The double seam which also consumes aluminum is eliminated by substituting an adhesive telescoped joint.

The top of the new container is about 4 mils thick compared to the double seam flat top of 14 mils. The heavy flange thickness of 7 mils of double seamed cans is not required and is reduced to 4 mils.

A total package weight of about 20 pounds per one thousand cans is obtained versus 38–40 pounds for the present lightest weight aluminum cans.

The two pieces of the new can are assembled at the can plant and later filled through the small drink hole using conventional bottle fillers.

It is postulated that although aluminum cans 4 mils thick are about the thinnest that can be commercially made, steel cans 2 to 2½ mils in wall thickness are feasible. The elimination of a special alloy for the can ends by making the can of one alloy produces a uni-alloy can, therefore making it more valuable as scrap for recycling.

The improved can remains cleaner, has better pourability and can be reclosed and resealed.

The new container provides a novel top which increases container volume and can be as easily used for 16 oz. cans as well as for 12 oz. cans or even 10 oz. cans merely by lengthening or shortening the can body.

A feature of the new container is that it can be made on present existing equipment without excessive capital investment.

A dome-shaped top member is used having a novel shape including a dome-like center portion and a peripheral annulus or band portion which is joined to the center portion by a toroidal section, the annulus preferably terminating at its lower edge in an outwardly turned flange which not only strengthens the annulus against radial deflection but also provides on its underside a bell-shaped pilot surface for guiding the end member into an interference fit assembly with a necked-in section formed at the upper end of the body portion of the can, the necked-in section terminating at its lower end in an outwardly extending shoulder which merges into the can body section therebelow, the shoulder providing a stop which the flange at the lower end of the top portion engages when the top is fully entered over the necked in section which is secured to the top portion by a suitable preferably thermoplastic or thermosetting adhesive of well known kind.

Advantage is taken of the shape of the top and of the thinness of about 0.004 inch and short axial length of the top with respect to the body length of the container to which the top is applied by shaping the top in a manner such that on filling the container with pressurized beverage forces are exerted on the cone section of the top to cause beamloading of the cone section to exert inward forces on the lip at the base of the cone portion to assist the adhesive by applying compressive forces thereagainst and to the portion of the opposing body portion at the telescoped junction of the body and top. Peeling forces on the adhesive in the bonded telescoped junction as would ordinarily occur are thus eliminated. Various configurations of the top portion are shown which obtain specific benefits as hereinafter defined.

In 12 oz. cans, the body has a diameter of 2.60 inches and an axial length of 4 inches whereas in the 16 oz. can, the body length or height is 4.75 inches.

In order to obtain a beaming action wherein the forces of expansion acting on the conical portion of the top produce compressive forces on the lip, the toroidal section, which provides the transition between the sloping conical section and the axial lip section, is accurate in cross section and has a radius 3/16 to ½ inch. It has been found that as the material used becomes thinner, the radius must be made larger. If the beaming forces were to be restricted or with a sharp angle at the juncture, the conical portion would buckle and wrinkle adjacent to the lip.

The invention comprehends providing a transition between the cone and the lip such that the forces tending to expand the conical section as well as the toroidal portion are utilized to produce a compressive force radially inwardly on the lip which together with the tensile forces tending to expand the upper end of the body portion insures parallelism between opposing body and lip portions and thus precludes developing voids such as would produce leaking joints.

Furthermore, the invention comprehends making an adhesively bonded joint as an extremely narrow axial band on the order of 1/16 to ⅛ of an inch which is now feasible because of the hoop loading on the lip and the opposing tensile loading on the body portion.

In steel cans to be comparable to the aluminum cans, the wall thickness of both the top and bottom sections of the can would be on the order of 2 to 2½ mils thick or 0.30 mm (0.0118 in.) thick which in Europe and particularly in Holland is identified as E5,6/5,6 (0.50) Flow Brightened Type and Temper DKK (Type D Killed) T52 BA (Temper).

These and other objects and advantages inherent in and encompassed by the invention will become more apparent from the specification and the drawings, wherein.

Figure 11:
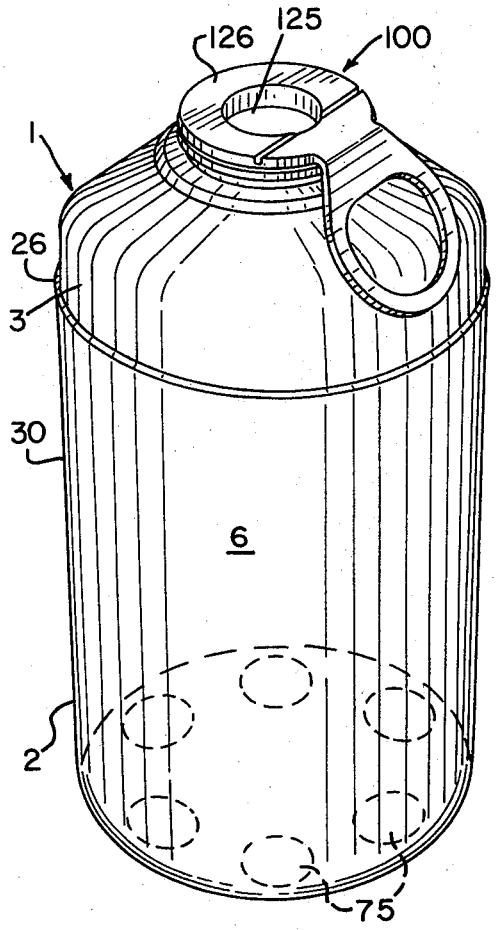
FIGS. 11–14 illustrate a further embodiment of the invention.
Figure 12:
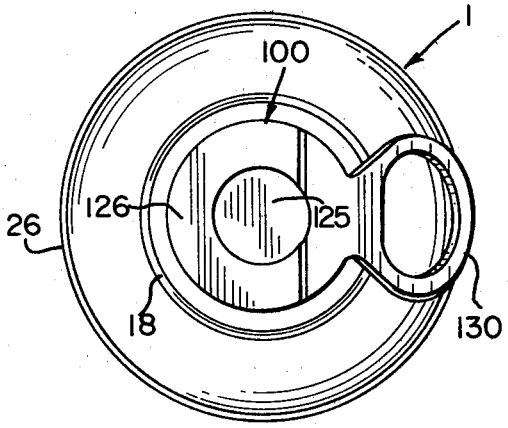
Figure 13:
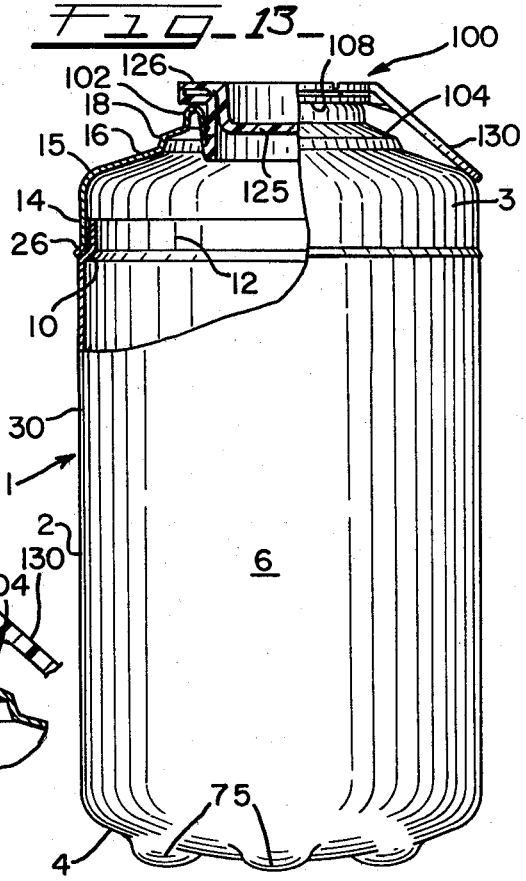
Figure 14:
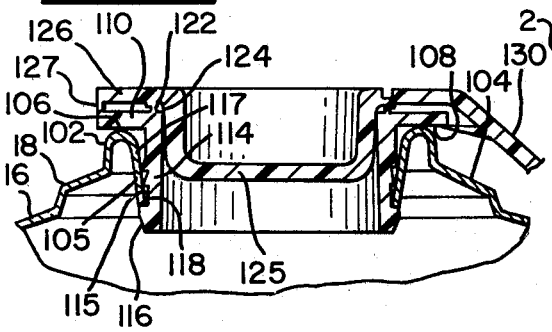

FIG. 11 being a perspective view;

FIG. 12 being a top plan view;

FIG. 13 being a side elevational view partly in vertical section taken substantially on line 13—13 of FIG. 12, and FIG. 14 is an enlarged portion of a part of FIG. 13.

DESCRIPTION OF FIGS. 1–5 OF THE INVENTION

The invention as shown in FIGS. 1–5 of the drawings, comprises a novel container, generally designated 1, preferably entirely formed of one alloy of aluminum such as H19-3004.

The container has a lower or bottom portion 2 and an upper or top portion 3. The lower portion comprises a bottom 4 and an integral cylindrical body 6 which at its upper end 8 is necked in to provide a radially inwardly extending shoulder 10 about 1/32 to 1/16 of an inch wide and about the inner edge of which there is an axially extending annulus or ring 12 of approximately ⅛ of an inch in length.

Figure 2:
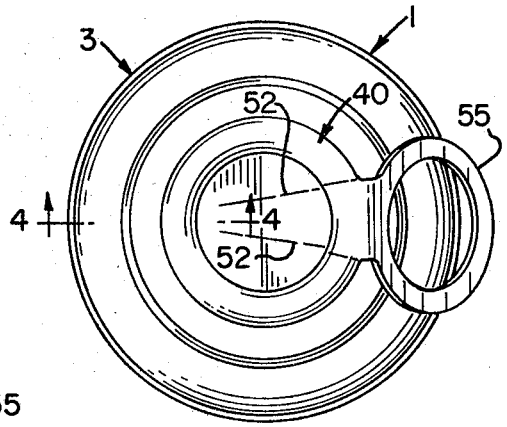
FIG. 2 is a top plan view thereof.
Figure 1:
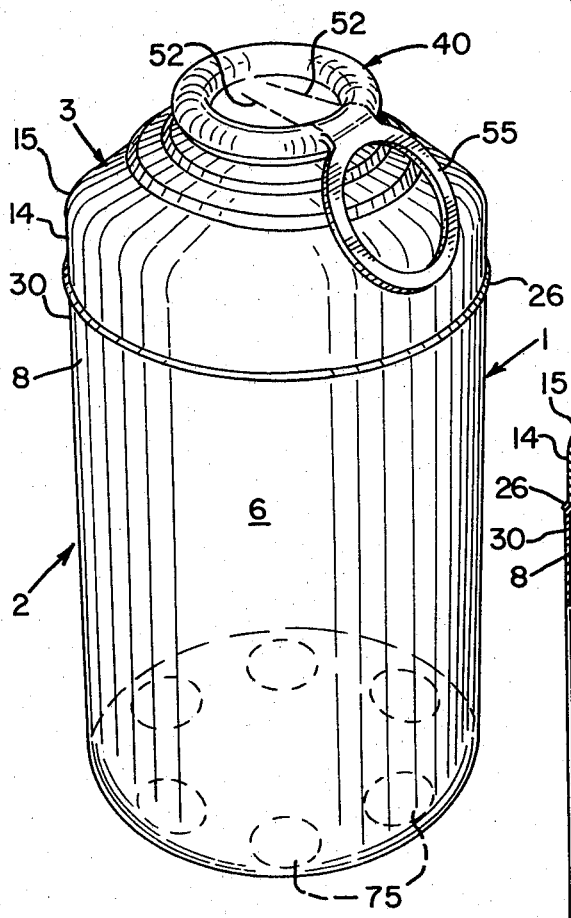
FIG. 1 is a perspective view of one embodiment of the invention.
Figure 3:
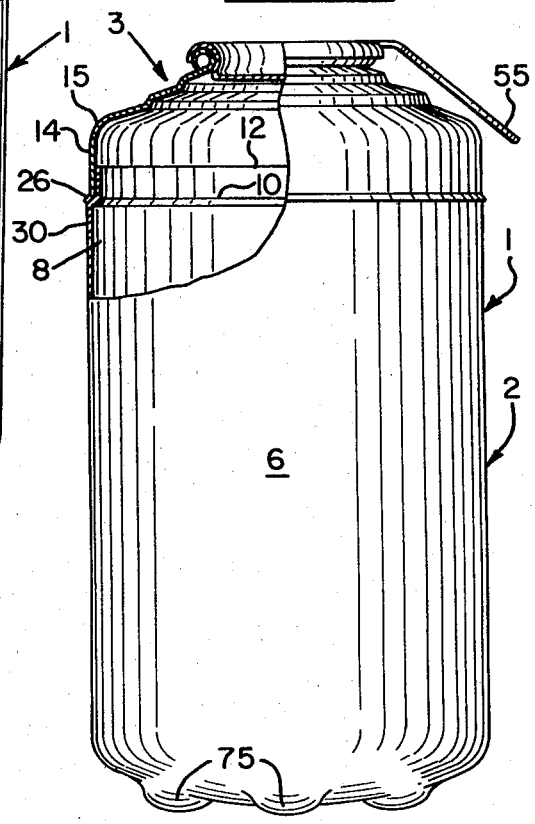
FIG. 3 is a side elevational view thereof shown partly in axial section.
Figure 4:
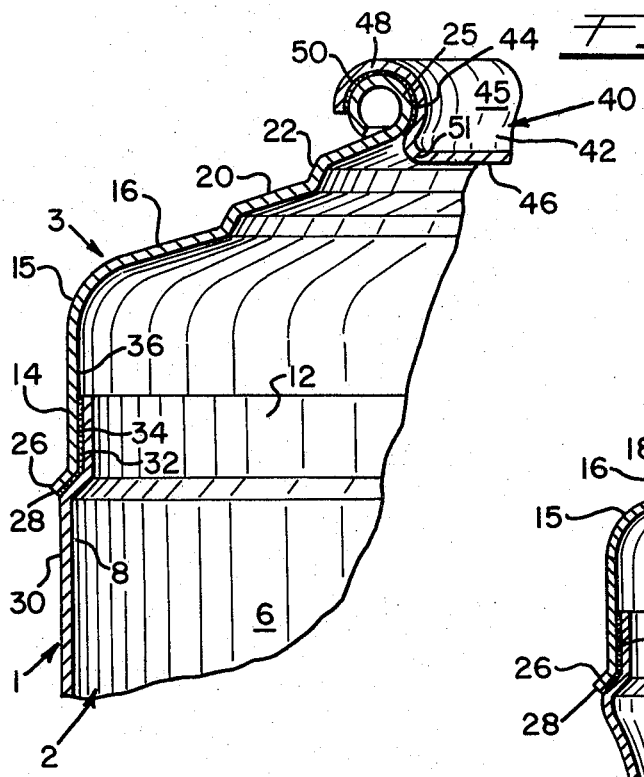
FIG. 4 is an enlarged fragmentary sectional view taken substantially on line 4–4 of FIG. 3.
Figure 5:
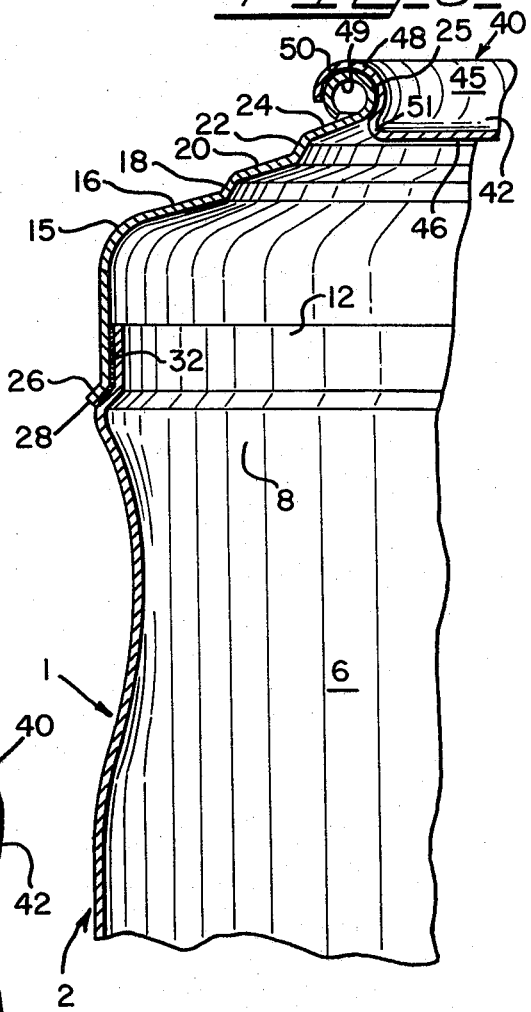
FIG. 5 is a view similar to FIG. 4 showing the container wall portion partly inducted.

The annulus or ring 12 has a tight or interference fit into the lower end of an annular band or lip 14 of the top portion 3 which is about 0.837 inches in total axial depth. The upper edge of the lip 14 merges into the lower edge of a toroidal or arcuate transition section 15 which at its upper edge merges into the lower edge of a conical section 16. The section 15 has a radius of between 2/16 inch to ½ inch. Preferably the thinner the metal, the greater the radius. The conical section 16 shown in FIGS. 1 and 5 is of a stepped design and comprises a frusto-conical annular band 18 which merges at its lower edge with the upper edge of the toroidal section and the upper edge of band 18 merges with the lower edge of the conical segment 20 which at its upper edge in turn merges into the lower edge of a second smaller frusto-conical band 22, the latter having its upper edge merging into the lower edge of a second frusto-conical section 24 which at its upper edge merges into a curl 25 which is turned outwardly over the second section 24.

The lower edge of the lip 14 is provided with an outturned downwardly flaring frusto-conical flange 26 which has an outer edge substantially coaxial with the external circular surface 30 of the body portion of the container. A preferably thermoplastic resin or adhesive such as polyvinyl chloride and thermoplastic resin such as polyethylene or polypropylene or alternatively thermosetting expoxy resin, or vinyl plastisol is applied to the outer side 34 of the ring 52 and to the inner surface 36 of the lip prior to assembly of the top to the lower portion so that after assembly the assembled can is heated to a temperature melting the plastic adhesive during which time the top and lower portions of the can are relatively axially or circumferentially moved to eliminate any pin holes or the like formed in the adhesive and to promote good adhesion of the adhesive to the metal parts. Upon cooling, the adhesive bonds the parts together.

In the instant invention, a metal closure 40 is shown in FIGS. 1–10 for purposes of illustration, it being understood that plastic closures of various kinds such as shown in FIGS. 11–13 may also be used. The closure comprises a center plug 42 which fits into the pour opening 44. The plug has an axially extending side wall 45 which at its lower end is connected to a bottom wall 46 at its upper end has a downwardly open outward curl 48 which overlays the convex upper side 49 of the curl 25 and is drawn tightly against a foam gasket sealing material 50 applied thereto by mechanically crimping and expanding the side wall 45 of the plug to form a shoulder 51 under the curl.

The wall 46, side wall 45 and curl 48, are scored at 52,52 and a ring type opener 55 is formed with the closure or cap and bent downwardly to extend generally parallel with the conical section of the upper portion. The closure is readily opened by lifting the ring 55 thus breaking the scores 52,52 and thus lifting the closure out of the pour opening.

One of the features of the invention is that the side wall of the body portion of the can is made of substantially uniform thickness on the order of 4 mils although cans have been made from material of between 12 and 8 mils and with reduction in side wall thickness to 5 to 4 mils respectively. The side wall thickness has been maintained substantially uniform from end to end, there being no necessity for a thick zone about the open end since the double seaming has been eliminated. It is, however, feasible to make the entire side wall of the container of a metal thickness of about 4 mils and the bottom of about 4–8 mils. However, if desired, variable thicknesses may be incorporated in various zones of the side wall.

The novel telescoping arrangement of the lip of the top and the necked-in band of the bottom portion and the provision of the outturned flange on the lower edge of the lip has been found to provide exceptional resistance to impact breeching of the connection. The flange 26 materially improves the radial strength of the lip portion of the top and the configuration of the lip and torroidal and conical sections develop a compression loading on the connection which together with the radial shoulder and necked in band of the lower section resist inward displacement and thus do not extend peel stresses to the adhesive.

This feature is amply illustrated in FIG. 5 wherein the body portion is depressed immediately below the necked in region. The shoulder 10 stops the body from deflecting inwardly and thus prevents peeling of the adhesive. Furthermore, the thin metal top, upon being pressurized, when the can is filled with pressurized beverage, becomes a prehensible member and wants to expand its conical section into a sphere. This in turn loads the lip portion in compression which resists the expansion of the necked-in portion and holds the adhesive in compression therebetween.

EMBODIMENT OF FIG. 6

In This embodiment, as well as all others, parts which are identical with the other embodiments are identified by the same reference numerals.

Figure 6:
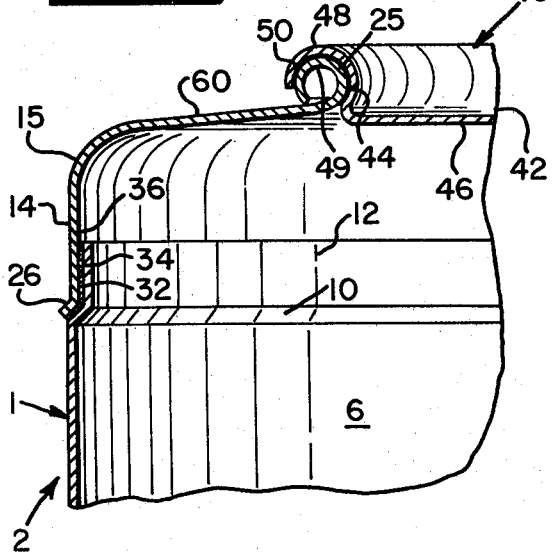
FIG. 6 illustrates a further embodiment incoporating a modified upper portion of the container.
Figure 7:
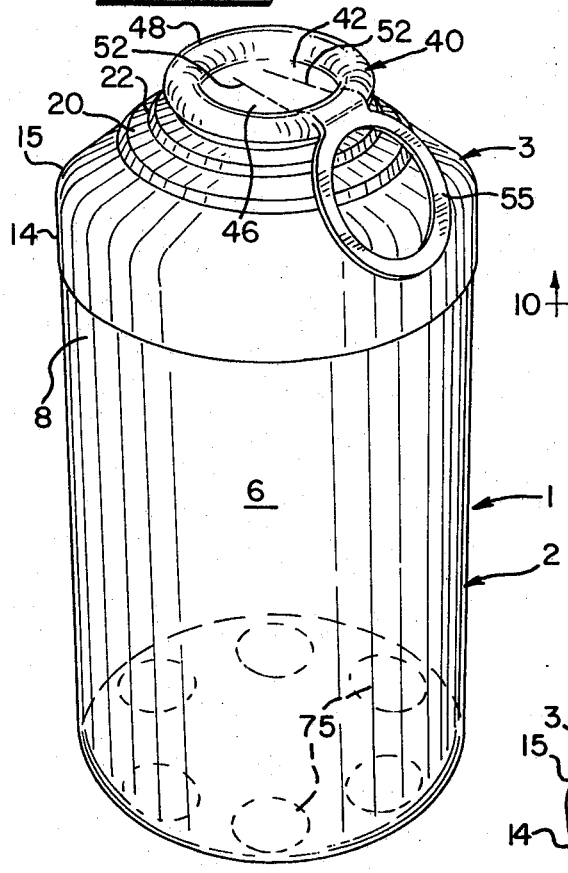
FIG. 7 is a perspective view illustrating a further embodiment of the invention.
Figure 8:
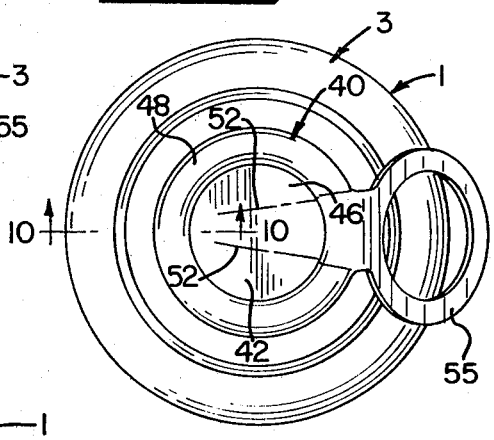
FIG. 8 is a top plan view thereof.
Figure 9:
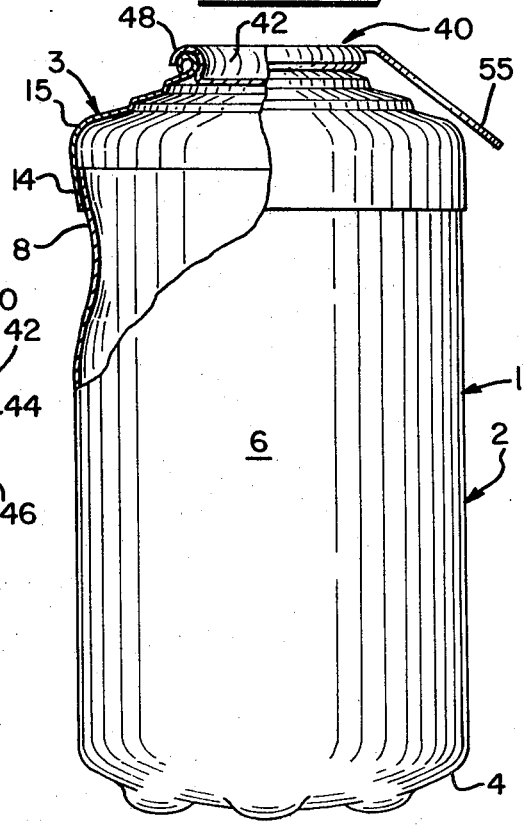
FIG. 9 is a side elevational view thereof partly in axial section.
Figure 10:
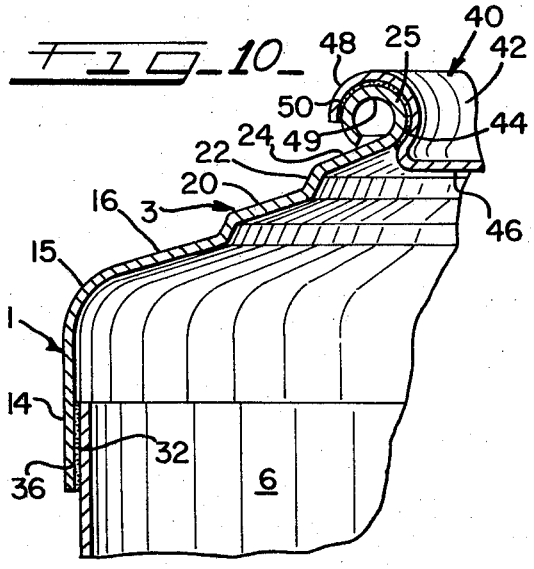
FIG. 10 is an enlarged cross-section taken substantially on line 10—10 of FIG. 8.

As seen in FIG. 6, the top portion of the container is an unstepped conical section. In this embodiment the transition from the toroidal section 15 to the curl is a smooth single conical section 60 a design satisfactory depending on the stacking strength required of the container.

EMBODIMENT OF FIGS. 7–10

In this embodiment of the necked-in structure at the upper end of the body section is eliminated and the upper end of the body portion 6 is a continuous cylinder which is slightly precompressed and fitted into the lip 14 of the top portion 3. The adhesive is thus held in compression between the lip 14 and the upper portion of the body 6.

In this embodiment the bottom and top portions of the container are of the same diametrical dimension. The bottom portion is precompressed about its upper edge portion 8 prior to insertion into the top lip 14 of the upper portion and then is released compressing the adhesive between the inner surface of the lip and the outer surface of the upper portion 14. The adhesive is preferably a thermoplastic type such that after the container portion of any of the previous or subsequent embodiments are assembled and they are passed through a heating chamber, the adhesive melts and fuses the top and bottom portions into a unitary structure. In this embodiment it will be appreciated that the joint is flexible because of the wall thicknesses being of the order of 4–8 mils, preferably the former and the adhesive is flexible. Thus, when the container is struck with a side blow in the body wall adjacent to the joint, the extremely thin section of material, that is, the metal and the plastic adhesive, allows the joint to flex inwardly thus attenuating the forces and inhibiting these forces from applying peeling loads on the adhesive and separating the inner portion from the lip.

EMBODIMENT OF FIGS. 11–14

In this embodiment the structure of the bottom portion 2 is the same as in the embodiments of FIGS. 1–5.

The top, however, is made to accommodate a different type of closure 100.

In this embodiment the neck 102 at the top of the stepped cone 104 is elongated and has an inturned frusto-conical lip 105 which forms a smooth apical annulus 106 against which the bottom side 108 of a radial flange 110 of the plastic closure 100 seats.

The flange 110 is connected to a hollow sleeve 114 which fits into the lip 105 and has external sealing shoulders or rings 115 and 116. Shoulder 115 wedges against the top internal angular surface 117 of the lip 105 and the shoulder 116, which is at the bottom of the sleeve 114 underlaps the lower edge 118 of the lip 105 and tightly engages therewith. At the juncture of the upper end of the sleeve 114 and flange 110 there is provided an integral tearable thin membrane 122 which is also integral with the outer peripheral edge portion 124 of a depressed closure plug 125 which is integrated with a hinge ring 126 connected by hinge 127 to the flange 110 and at the diametrically opposite side to a pull tab 130 which is angled downwardly toward the cone top portion. Lifting of the tab rips the membrane 122 and opens the container.

It will be noted that in each container, the bottom 4 is convex and has feet 75. The bottom wall thickness is usually the initial thickness of the blank sheet preparatory to forming of the can, that is 10–6 mils, preferably 8 mils, thick. The body wall is ironed to about 5 mils or less. The top portion is also less than 10 mils thick preferably 4–7 mils and the pour opening is less than 30% of the bottom area. The angle of the conical portions is between 25–30 degrees in the stepped designs, as well as in the unstepped design of FIG. 6. However, to obtain greater axial strength, an angle of 45 degrees would be preferred, but that is dependent upon other desired parameters. The stepped design greatly improves the axial strength of the top.

It will become apparent from the foregoing disclosure that novel lightweight pressure holding containers have been developed which adequately contain pressurized beverages, use a minimum amount of metal and strategically employ the metal to obtain a container of improved characteristics which constrain the forces to act in favorable manner assisting in holding the adhesive bond from being breeched.

I claim:

1. A container for pressurized products comprising cylindrical top and bottom portions, said bottom portion having an open top end section, said top portion being a relatively axially short prehensible member telescoped over said open top end section and having a thin top wall of such dimension as to be operative upon internal pressure being applied thereagainst to effect a hoop stress along a bottom edge of said top portion operative against said top end section of the bottom member, and an adhesive securing said top and bottom portions to each other along said open top end section and the bottom edge of said top portion, said top wall being toro-conical in shape, said top portion at said bottom edge comprising an axially extending cylindrical lip axially overlapping the open top end section of the bottom portion, and said top wall including a frusto-conical section spaced from and above and tapering away from the lip, said frusto-conical section having a lower wide end adjacent the lip and therebeing a toroidal transition section between said wide end of the frusto-conical section and said lip.

2. The invention according to claim 1 and said arcuate transition portion having a radius of at least 3/16 of an inch.

3. The invention according to claim 2 wherein said frusto-conical section has an angle of between 20°–45° to a radial plane extending through the longitudinal axis of the container.

4. The invention according to claim 1 wherein said arcuate transition portion has a radius of not greater than ½ inch.

5. The invention of claim 1 wherein the top and bottom portions are made of the same type of sheet metal.

6. The invention according to claim 5 and said top sheet metal being aluminum.

7. The invention according to claim 5 and said sheet metal being steel.

8. The invention according to claim 5 and said sheet metal being no more than 8 mils thick and being aluminum.

9. In a container structure, a pair of container-forming metal members having cylindrical wall portions in telescoped relation defining an overlap joint, a flexible adhesive bonding the overlapping portions of said walls and each member having a wall thickness below 10 mils, said walls being laterally pliable without permanent deformity determined to accommodate loads imposed laterally thereagainst, said joint being formed and arranged to transmit said loads from one member to the other through said joint to attenuate said loads and flexing of said walls together and not individually such as would separate the walls from each other at said joint and impose peeling forces on the adhesive, one of said members having a relatively short length with respect to the other and having an outer dome section joined to said cylindrical wall portion thereof by a toroidal section which outer dome section upon said container being internally pressurized and being loaded in tension, said one member tending to assume a spherical shape thereby loading the telescoping portion thereof in compression toward the axis of said container, and said dome section having a series of annular steps.

10. A metal can for pressurized beverage products comprising an open top one piece metal body formed from sheet stock 10 mils or less in thickness and having a bottom and an integrally joined generally cylindrical side wall terminating remote from said bottom in a side wall open upper end portion defined by an open upper edge portion, the side wall thickness being greatest in the bottom area and of lesser thickness toward the open end with the open edge portion being of a thickness of 5 mils or less, a generally toroconical top formed of metal and having a generally cylindrical lower lip portion with which said side wall upper end portion telescopes, and adhesive bonding said side wall upper end portion to said cylindrical lower lip portion, said top having a generally conical upper portion joined to said cylindrical lower lip portion by a toroidal section and reduced in diameter from said toroidal portion to an opening having an area less than 30% of the area of the bottom, said opening providing for filling and discharge of beverage, said generally conical upper portion providing a force reacting surface area opening to the internal pressure of pressurized beverage within the can to cause said lower lip portion to be beamed radially inwardly and the force couple created thereby to be transmitted to the adhesively bonded telescoped junction.

11. A metal can for pressurized beverage products comprising aluminum alloy of sheet stock initially less than 10 mils thick formed into a body having a generally cylindrical side wall having an integral bottom with the cylindrical side wall being of a thickness of 5 mils or less and an upper end portion of said side wall being necked in to define an annulus portion terminating in an upwards extending cylindrical portion, a generally toroconical top of aluminum alloy, formed from sheet stock initially less than 10 mils thick and having a generally cylindrical bottom lip portion of a diameter substantially equal to the side wall diameter below said annulus portion and into which said side wall upper necked-in cylindrical portion telescopes, and adhesive bonding the outer surface of said upper necked-in cylindrical portion to the inner surface of said cylindrical bottom lip portion, said top being reduced in diameter from said cylindrical bottom lip portion on an angle of 45 degrees or less to a central opening for filling and discharge of beverage, the reduced diameter forming a generally cone-shaped wall joined to said cylindrical bottom lip by a toroidal section with said cone-shaped wall being of relatively short axial container length with respect to said body length whereby the pressure within the container on filling with pressurized beverage causes forces on the generally cone-shaped wall to cause a beaming action of the thin metal of the top and exert inward forces on the cylindrical lip portion assisting said adhesive by providing compressive pressure.

12. The invention according to claim 11 wherein said side wall metal is thickest near the bottom area and thinnest at its progresses to an extreme upper open end of the body wall with the upper edge portion of the side wall being of said thickness of 5 mils or less.

13. The invention according to claim 12 and said body upwardly extending cylindrical portion being of a diameter reduction slightly greater than the thickness.

14. The invention according to claim 12 and said side wall annulus portion defining a radially extending shoulder, and said top having a terminal edge portion seating against said shoulder.

15. A metal can for pressurized beverage products comprising an opening top one-piece metal body made of aluminum alloy formed from sheet stock initially less than 10 mils thick into a generally cylindrical side wall having an integral bottom with the cylindrical side wall metal being thickest near the bottom and thinnest as it progresses to an extreme upper open end of the side wall with an upper end portion of the body side wall being of a thickness of 5 mils or less and said upper end portion being necked-in having an annulus portion and an upwardly extending cylindrical portion having a diameter reduction as compared to the diameter of said side wall slightly greater than the side wall thickness, a generally toro-conical top of aluminum alloy, formed from sheet stock initially less than 10 mils thick and having a generally cylindrical bottom lip portion of a diameter substantially equal to the side wall diameter below said annulus portion and into which said body upper necked-in cylindrical portion telescopes, and adhesive bonding the outer surface of said upper necked-in cylindrical portion to the inner surface of said cylindrical bottom lip portion, said top being reduced in diameter from said cylindrical bottom lip portion on an angle of 45 degrees or less to a central opening for filling and discharge of beverage, the reduced diameter forming a generally cone-shaped wall joined to said cylindrical bottom lip portion by a toroidal section with said cone-shaped wall being of relatively short axial container length with respect to said body length whereby pressure within the container on filling with pressurized beverage causes forces on the generally cone-shaped wall to cause a beaming action of the thin metal of the top and thereby to exert inward forces on the cylindrical bottom lip portion assisting said adhesive by compressive pressure, and said annulus portion of the body immediately adjacent the telescoped junction minimizing forces on said side wall from being transmitted to the adhesively bonded telescoped junction.

* * * * *